United States Patent [19]

Auguste

[11] 4,408,617

[45] Oct. 11, 1983

[54] APPARATUS FOR DETECTING THE ACUPUNCTURE POINTS ON A PATIENT AND FOR APPLYING ELECTRICAL STIMULATING SIGNALS TO THE DETECTED POINTS

[76] Inventor: Deloffre Auguste, 13 bis, rue George Sand, 94500 Champigny S/Marne, France

[21] Appl. No.: 226,014

[22] Filed: Jan. 19, 1981

[30] Foreign Application Priority Data

Jan. 21, 1980 [FR] France ..... 80 01177

[51] Int. Cl.[3] ..... A61H 39/02; A61H 1/36

[52] U.S. Cl. ..... 128/735; 128/421; 128/907

[58] Field of Search ..... 128/734, 735, 419 R, 128/420 R, 421, 422, 423 R, 907

[56] References Cited

U.S. PATENT DOCUMENTS

| | | | |
|---|---|---|---|
| 2,111,135 | 3/1938 | Bagno | 128/734 |
| 2,764,683 | 9/1956 | Paust et al. | 128/423 X |
| 2,827,041 | 3/1958 | Pierson | 128/734 |
| 3,207,151 | 9/1965 | Takagi | 128/735 |
| 3,670,737 | 6/1972 | Pearo | 128/422 |
| 3,897,789 | 8/1975 | Blanchard | 128/907 X |
| 3,900,020 | 8/1975 | Lock | 128/735 |
| 4,102,347 | 7/1978 | Yukl | 128/421 |

FOREIGN PATENT DOCUMENTS

| | | | |
|---|---|---|---|
| 997670 | 7/1965 | United Kingdom | 128/735 |

*Primary Examiner*—Lee S. Cohen

*Attorney, Agent, or Firm*—Gottlieb, Rackman & Reisman

[57] ABSTRACT

An apparatus for detecting the acupuncture points on a patient and for applying electrical stimulating signals to the detected points, comprising a generator delivering sawtooth signals to a contact needle of a probe through a first fixed resistor and a variable resistor. For operation in a stimulation mode, at least a second fixed resistor and at least a second capacitor may be placed in parallel respectively across the first fixed resistor and across a first capacitor of the generator by means of appropriate switches. A voltage booster delivering at least one DC voltage higher than that of a main supply source of the apparatus may be switched on for increasing the peak-to-peak voltage of the sawtooth signals in the stimulation mode.

9 Claims, 4 Drawing Figures

AMP.
HP
OSC
+Va
+Vo
B
CA
CA12
CA1a
CA1b
CA1c
CA1d
CA2a
CA2b
CA2c
CA2d
PT
E
P

APPARATUS FOR DETECTING THE ACUPUNCTURE POINTS ON A PATIENT AND FOR APPLYING ELECTRICAL STIMULATING SIGNALS TO THE DETECTED POINTS

BACKGROUND OF THE INVENTION

The present invention relates to an apparatus for detecting the acupuncture points of a patient and for applying stimulating electrical signals to the detected points, of the type comprising a probe having a contact needle which is electrically connected to a generator of electric sawtooth signals, the rise time of each sawtooth being determined by a first capacitor and by a resistive circuit comprising, connected in series in use, a first fixed resistor, a variable resistor, said contact needle, the skin of the patient and an electrode held by the patient, and mode-changing means for selecting between an acupuncture point detection mode and an electrical stimulation mode, said mode-changing means comprising a first switch means connected to the resistive circuit for modifying the ohmic value thereof from a high ohmic value for the acupuncture point detection mode to a lower ohmic value for the electrical stimulation mode.

FIG. 1 of the enclosed drawings shows the simplified diagram of a known apparatus of the above-mentioned type. The sawtooth signal generator may be a conventional relaxation oscillator OSC formed for example by a unijunction transistor T, two resistors $R_1$ and $R_2$ and a capacitor $C_0$. The emitter of the unijunction transistor T is connected through a fixed resistor $R_3$ (which can be short-circuited by a switch I for the stimulation mode) and by a variable resistor P to the contact needle or stylus PT of a probe S. The emitter of the unijunction transistor T is also connected to a power amplifier, itself connected to a loudspeaker and/or an indicator or a device for displaying the sawtooth signals or their frequency (not shown in FIG. 1). In FIG. 1, E designates an electrode or a handle intended to be held by the patient, and $R_4$ designates the resistance of the skin of the patient between contact needle PT and electrode E. The value of resistance $R_4$ varies significantly according as the contact needle PT is placed on an acupuncture point or on the surrounding skin. By way of indication, $R_4$ may have a value of 60 kΩ on an acupuncture point and 500 kΩ on the surrounding skin. These values themselves vary with individuals, the type of skin, the position of the acupuncture point, etc. FIG. 2 of the accompanying drawings shows the wave form of the sawtooth signals delivered by such an apparatus. The rise time $t_1$ of each sawtooth pulse or charging time of capacitor $C_0$ depends on the products $R.C_0$, R being the sum of the ohmic values of resistor $R_3$, variable resistor P and resistance $R_4$. In practical operation, this time $t_1$ also corresponds to the repolarization of the cutaneous point, this repolarization itself being required for efficient stimulation. $t_2$ is the discharge time of capacitor $C_0$ through the unijunction transistor T and resistor $R_2$ to ground. This time $t_2$ also corresponds to the depolarization or stimulation of the acupuncture point. The energy which is transferred is proportional to the value of the product $\Delta V.t_2$ (hatched area in FIG. 2), $\Delta V$ being the peak-to-peak voltage of the sawtooth signal (about 60% of the DC supply voltage $V_0$).

For the detection mode (localization of the acupuncture point), the charging current of capacitor $C_0$ as well as the discharge energy must be as small as possible, for example about 1 μA, thus explaining the presence of resistor $R_3$ (switch I being open) and of variable resistor P the value of which is adjusted according to the individual. On the other hand, for the stimulation mode (treatment of the acupuncture point) the energy to be supplied must be much higher, for example the current must be of the order of 50 to 160 μA, which explains the presence of switch I for short-circuiting resistor $R_3$.

Furthermore, to obtain good selectivity in the detection mode, i.e. for localizing with certainty the acupuncture point, the frequency ($1/T_0$, with $T_0=t_1+t_2$) of the sawtooth signal must be able to vary substantially according as the contact needle PT is placed on the acupuncture point or on the surrounding skin.

It results therefrom that the operation of the known apparatus as a detector and as a stimulator of acupuncture points is based on a compromise between the value of the capacity of capacitor $C_0$ compatible with the two modes of operation and the ohmic value of resistor $R_3$ whose short-circuiting by switch I must reduce, in the stimulation mode, the overall resistance of the resistive circuit ($R_3$, P, $R_4$) so as to increase the value of the current, the frequency of the sawtooth signal and, consequently, the number of energy transfers on discharge of capacitor $C_0$. The compromise must also take into account the fact that in the two modes of operation, time $t_1$ must be sufficient to allow the cutaneous tissue to be repolarized before the next discharge of capacitor $C_0$. Accordingly, as in any compromise solution, it is not possible to obtain perfect operation both in the detection mode and in the stimulation mode.

Other apparatus are also known for detecting and stimulating acupuncture points which, so as to get free of the above problems, use a circuit in accordance with the diagram of FIG. 1 (without switch I) for the detection mode and another totally separate circuit capable of generating pulses of various types having different shapes and of a controlled frequency for the stimulation mode, either of these two circuits being able to be selectively connected of the contact needle by means of a mode selector. The known apparatus of this latter type do not take into consideration, or very little, the physiological problems inherent in electric stimulation, particularly problems of electric and progressive repolarization of the skin in accordance with natural laws and, accordingly, their efficiency is reduced thereby.

SUMMARY OF THE INVENTION

The object of the present invention is to provide an improved apparatus of the first above-mentioned type for detecting and stimulating acupuncture points, which has correct operation from all the points of view outlined above not only in the direction mode but also in the stimulation mode.

Another object of the present invention is to provide an apparatus of the first above-mentioned type, capable of supplying several degrees of treatment (stimulation).

Another object of the present invention is to provide an apparatus of the first above-mentioned type, which is very simple to use.

To this end, the apparatus of the present invention is characterized in that the first switch means are adapted to insert a second fixed resistor in parallel across the first fixed resistor for the stimulation mode, and in that the mode changing means further comprise a second switch means adapted to insert a second capacitor in parallel across the first capacitor for the stimulation mode.

The apparatus may further comprise, in addition to a main supply source, a voltage booster adapted to supply the electric signal generator with a DC voltage higher than that of the main supply source. In this case, the mode-changing means may comprise a third switch means adapted to switch-on the voltage booster for the stimulation mode.

Thus, we now have two or three variable parameters, the resistance, the capacity and the voltage (instead of a single variable parameter in the known apparatus of the prior art), so that in choosing appropriate values for the resistors, capacitors and voltages, it is possible to obtain efficient detection and efficient treatment (stimulation), i.e. taking into account the physiological problems (depolarization and repolarization of the cutaneous point, times $t_1$ and $t_2$, current and energy transferred on discharge of the capacitor, number of energy transfers per unit of time) and the selectivity (frequency of the sawtooth signal) not only in the detection mode but also in the stimulation mode.

For reinforced treatment, the mode-changing means may further comprise fourth and fifth switch means adapted to insert respectively a third fixed resistor in parallel across the assembly of the first fixed resistor and the variable resistor, and a third capacitor in parallel across the first capacitor. Furthermore, the voltage booster may be adapted to deliver a first DC voltage and a second DC voltage of a higher value than that of the first DC voltage, and the mode-changing means may comprise a sixth switch means, the third and sixth switch means being combined with the voltage booster so that the latter delivers the first DC voltage for the stimulation mode and the second DC voltage for the reinforced stimulation mode.

DESCRIPTION OF THE DRAWINGS

Other features and advantages of the present invention will be better understood from the following description of a preferred embodiment of the apparatus of the invention, given with reference to the accompanying drawings in which:

In FIGS. 3 and 4, the parts which are identical or which have the same function as those which have already been described with reference to FIG. 1 are designated by the same reference symbols.

DESCRIPTION OF THE PREFERRED EMBODIMENT

Figure 3:
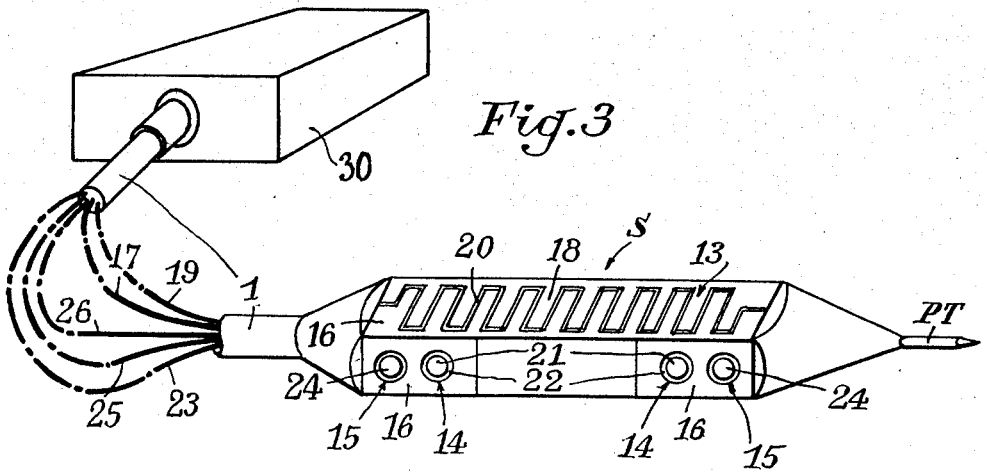
FIG. 3 shows a probe forming part of the apparatus of the invention.
Figure 4:
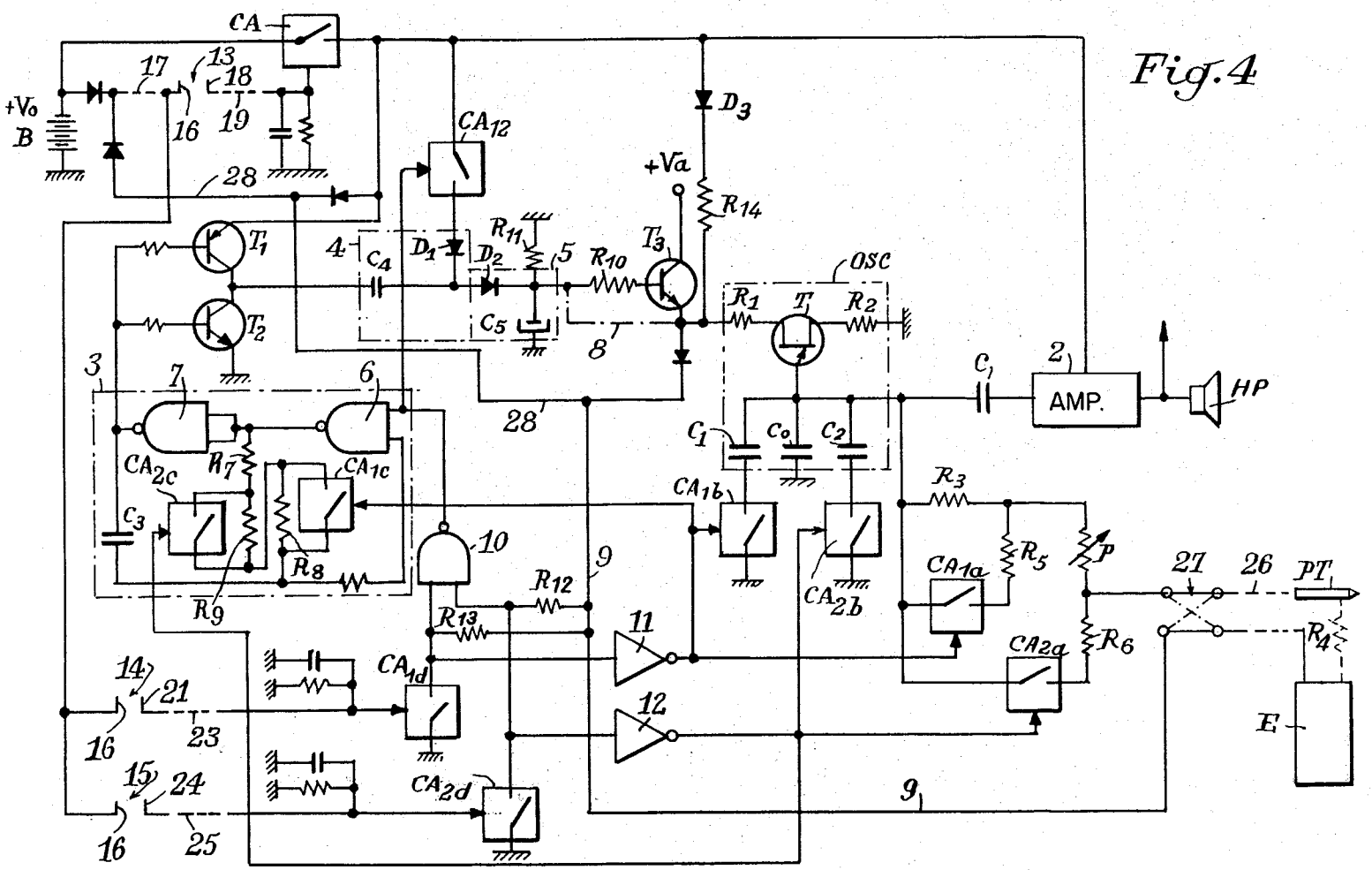
FIG. 4 shows the circuit diagram of the apparatus of the present invention.

The apparatus of the invention comprises, in a known manner, a housing 30 diagrammatically shown in FIG. 3 which contains most of the elements shown in FIG. 4 and which is connected by a flexible multiwire cable 1 to probe S provided with a contact needle or stylus PT preferably retractable.

Figure 1:
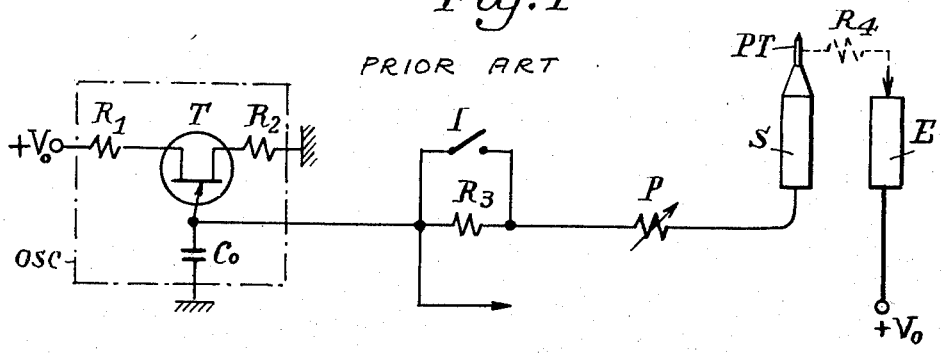
Fig. 1 PRIOR ART
FIG. 1 shows the simplified diagram of an apparatus of the prior art for detecting and stimulating acupuncture points.
Figure 2:
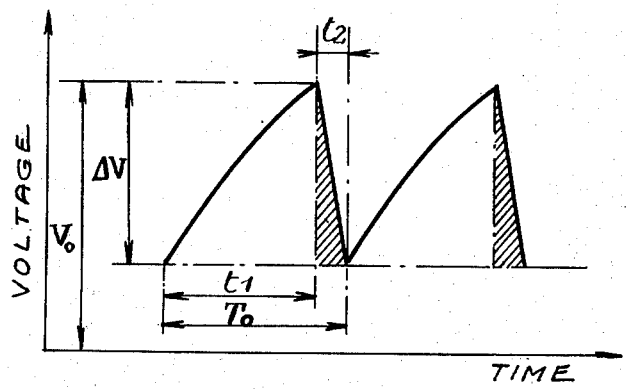
FIG. 2 is a diagram showing the wave form of the sawtooth signal delivered by the apparatus of FIG. 1 or by the apparatus of the invention.

As shown in FIG. 4, the apparatus of the invention comprises a relaxation oscillator OSC which is similar to that of FIG. 1 and the output of which is connected through resistor $R_3$ and variable resistor P to the contact needle PT. The output of oscillator OSC is also connected through a capacitor C to a power amplifier 2, the output of which is connected to a loudspeaker HP and, if need be, to an indicating device or to a display device (not shown) for indicating or displaying at least one of the electrical characteristics (average voltage, frequency) of the sawtooth signal, or else for displaying the signal itself.

In the apparatus of the invention, resistors $R_5$ and $R_6$ may be selectively connected in parallel across resistor $R_3$ and across the assembly of resistor $R_3$ and variable resistor P, respectively, by switches $CA_{1a}$ and $CA_{2a}$, respectively. Similarly, capacitors $C_1$ and $C_2$ may be connected in parallel across capacitor $C_0$ by switches $CA_{1b}$ and $CA_{2b}$, respectively.

Oscillator OSC and amplifier 2 are supplied with DC current from a main supply source, for example a battery B delivering a DC voltage $+V_0$ of 9 V, through an ON/OFF switch CA. However, for the treatment or stimulation mode, a voltage booster is provided for delivering to oscillator OSC and the rest of the apparatus (except amplifier 2) a higher DC voltage than voltage $+V_0$ of battery B. As shown, the voltage booster may comprise a variable-frequency clock 3, a voltage doubler 4 and an integrator 5. The clock 3 shown in FIG. 4 has a well-known structure. When a high-level trigger signal is applied to one of the two inputs of NAND gate 6, rectangular pulses appear at the output of the second NAND gate 7, which is also the output of clock 3. The rectangular pulses have a frequency which is determined by the values of capacitor $C_3$ and resistors $R_7$, $R_8$ and $R_9$. Resistors $R_8$ and $R_9$ may be short-circuited respectively by switches $CA_{1c}$ and $CA_{2c}$ to change the frequency of said pulses. The rectangular pulses delivered by clock 3 are used for charging to voltage $+V_0$ through a transistor $T_1$ and discharging to ground through a transistor $T_2$ at the timing of said rectangular pulses one of the armatures of a capacitor $C_4$, the other armature of which is charged to the voltage $+V_0$ through diode $D_1$ and switch $CA_{12}$ which, as will be seen further on, is closed during the treatment mode (stimulation). Thus, at the junction point between diode $D_1$ and capacitor $C_4$ pulses are obtained, which have the same frequency as the pulses delivered by clock 3, but a peak-to-peak voltage equal to $+2V_0$. These latter pulses are integrated by integrator 5 formed by a diode $D_2$ and a capacitor $C_5$. The average integrated voltage which is available at the terminals of capacitor $C_5$ will be variable with the frequency of the pulses delivered by clock 3, this frequency being variable by short-circuiting one or the other of resistors $R_8$ and $R_9$ or both these resistors. If the DC voltage $+V_0$ delivered by battery B is 9 V, the maximum value of the average integrated voltage available at the terminals of capacitor $C_5$ will be slightly less than 18 V.

The variable DC voltage available at the terminals of capacitor $C_5$ is applied to resistor $R_1$ of oscillator OSC, either directly as is indicated by the connection 8 shown by a dot-dash line or, if an auxiliary supply source $+V_a$ of for example 18 V is available, through a resistor $R_{10}$ and an emitter-follower transistor $T_3$. In the second case, a leak resistor $R_{11}$ must be connected in parallel across capacitor $C_5$. The DC voltage available at the terminals of capacitor $C_5$ or, as the case may be, at the emitter of transistor $T_3$ is applied to the whole of the apparatus (except amplifier 2) particularly, by means a conductor 9 to electrode E and, through resistors $R_{12}$ and $R_{13}$, to both inputs of a NAND gate 10, the use of which will be seen further on. For the detection mode, it will be noted that oscillator OSC is fed with DC current by battery B through the switch CA, a diode $D_3$, a resistor $R_{14}$ and resistor $R_1$.

Preferably, the switches $CA_{1a}$, $CA_{1b}$ and $CA_{1c}$ are electronic switches which are controlled by a switch $CA_{1d}$ having one of its terminals connected to ground and its other terminal connected on the one hand to one of the inputs of logic NAND gate 10 and, on the other hand, through an inverter circuit 11, to the control inputs of switches $CA_{1a}$, $CA_{1b}$ and $CA_{1c}$. Similarly, the switches $CA_{2a}$, $CA_{2b}$ and $CA_{2c}$ are electronic switches controlled by another switch $CA_{2d}$ having one of its terminals connected to ground and its other terminal connected on the one hand to the other input of logic NAND gate 10 and, on the other hand, through another inverter circuit 12 to the control inputs of switches $CA_{2a}$, $CA_{2b}$ and $CA_{2c}$. The output of logic NAND gate 10 is connected on the one hand to one of the inputs of logic NAND gate 6 and, on the other hand, to the control input of switch $CA_{12}$. For example, closing of switch $CA_{1d}$ causes a low level to be applied to the input of inverter circuit 11 which produces at its output a high level which causes switches $CA_{1a}$, $CA_{1b}$ and $CA_{1c}$ to close, and therefore resistor $R_5$ and capacitor $C_1$ to be placed in parallel respectively across resistor $R_3$ and across capacitor $C_0$, and resistor $R_8$ to be short-circuited. The low level at the output of switch $CA_{1d}$ is also applied to the corresponding input of logic NAND gate 10 which produces at its output a high level which causes, on the one hand, switch $CA_{12}$ to close and, on the other hand, clock 3 to start up. Therefore, clock 3 delivers rectangular pulses at the first frequency determined by capacitor $C_3$ and by series resistors $R_7$ and $R_9$, which pulses, after voltage doubling by circuit 4 and integration by integrator 5, will give a first DC voltage for supplying the whole of the apparatus (except amplifier 2). In a similar way, closing of switch $CA_{2d}$ causes resistor $R_6$ and capacitor $C_2$ to be placed in parallel respectively across the assembly of resistor $R_3$ and variable resistor P and across capacitor $C_0$, and resistor $R_9$ to be short-circuited. Closing of the switch $CA_{2d}$ also causes switch $CA_{12}$ to close and clock 3 to start up, which produces rectangular pulses at a second frequency higher than the first frequency and determined by capacitor $C_3$ and by series resistors $R_7$ and $R_8$, which pulses will give, after voltage doubling by circuit 4 and integrator 5, a second DC voltage higher than the first DC voltage. It will be noted that if switches $CA_{1d}$ and $CA_{2d}$ are closed simultaneously, resistor $R_5$ is placed in parallel across resistor $R_3$, resistor $R_6$ is placed in parallel across the assembly of resistor $R_3$ and variable resistor P, capacitors $C_1$ and $C_2$ are placed in parallel across capacitor $C_0$, resistors $R_8$ and $R_9$ are short-circuited, switch $CA_{12}$ is closed and clock 3 is started up. Therefore, clock delivers rectangular pulses at a third frequency higher than the first and second frequencies and the pulses thus produced give, after voltage doubling by circuit 4 and integration by integrator 5, a third DC voltage higher than the first and second DC voltages.

Switches CA, $CA_{1d}$ and $CA_{2d}$ are controlled respectively by control means 13, 14 and 15. Although the control means 13, 14 and 15 may be situated on the housing 30 of the apparatus, they are placed preferably on the body of probe S so as to facilitate the use of the apparatus. Switches CA, $CA_{1d}$ and $CA_{2d}$ may be constructed in the form of mechanical switches. In this case, control means 13, 14 and 15 may be formed by simple operating buttons or levers placed preferably on the body of probe S. However, switches CA, $CA_{1d}$ and $CA_{2d}$ may be formed by analog switches. In this case, the control means 13, 14 and 15 may be formed by touch controls, the electrodes of which are formed by metalization of appropriate zones of the body, made of insulating material, of probe S. As shown in FIGS. 3 and 4, touch controls 13, 14 and 15 have a common electrode 16 formed by a first metal zone formed on the insulating body of probe S and connected to the "+" pole of battery B by means of a conductor 17 of the multi-wire cable 1. The other electrode 18 of touch control 13 is formed by a second metal zone formed on the insulating body of probe S and connected to the control input of analog switch CA by means of a conductor 19. As can be seen in FIG. 3, the metal zones 16 and 18 are formed on one of the faces of the body of probe S (preferably also on the opposite face) and they have the form of two combs, the teeth of which are interdigited while being spaced apart by an insulating gap 20. Thus, whatever the place where the user takes hold of the body of probe S, the skin of the user will establish contact between metal zones 16 and 18, thus causing analog switch CA to close and, consequently, the apparatus to be brought into service. Conversely, when the user releases the probe, the contact between metal zones 16 and 18 will be broken, thus causing analog switch CA to open and, consequently, the apparatus to be placed out of service, thus avoiding a useless drain on battery B. The other electrode 21 of the touch control 14 is formed by at least one, preferably two, small disc-shaped metal areas 21 which are isolated from metal zone 16 by two annular insulating spaces 22 and which are connected to the control input of analog switch $CA_{1d}$ by means of a conductor 23. Thus, by putting a finger on one or the other of the two metal areas 21 and on the adjacent metal zone 16, analog switch $CA_{1d}$ is caused to close. Similarly, the other electrode 24 of touch control 15 is formed by two other small disc-shaped metal areas 24 which are connected to the control input of analog switch $CA_{2d}$ by means of a conductor 25. Finally, the contact needle PT of probe S is connected by means of a conductor 26 to the junction point between resistor $R_6$ and variable resistor P. As shown in FIG. 4, a changeover switch 27 may possibly be provided for interchanging the connections between the contact needle PT and the electrode or handle E. As can be seen in FIG. 4, the metal zone 16 of the body of probe S and electrode E are placed at the same potential (that available at the terminals of capacitor $C_5$ or at the emitter of transistor $T_3$) respectively by means of conductors 28 and 9. Consequently, the patient may use the apparatus of the invention for treating himself without using electrode E since, in this case, the metal zone 16 of the body of probe S may fulfil the role of electrode E.

By way of the example, the components of the circuit of FIG. 4 may have the following values:

| | | | | | |
|---|---|---|---|---|---|
| $V_0$ | = | 9 V | $R_1$ | = | 1.5 kΩ |
| $V_a$ | = | 18 V | $R_2$ | = | 100 Ω |
| $C_0$ | = | 22 nF | $R_3$ | = | 470 kΩ |
| $C_1$ | = | 33 nF | P | = | 1 MΩ |
| $C_2$ | = | 78 nF | $R_5$ | = | 47 kΩ |
| $C_3$ | = | 10 nF | $R_6$ | = | 15 kΩ |
| $C_4$ | = | 22 nF | $R_7$ | = | 33 kΩ |
| $C_5$ | = | 1 μF | $R_8$ | = | 30 kΩ |

-continued

| | | |
|---|---|---|
| $R_9$ | = | 56 kΩ |
| $R_{10}$ | = | 22 kΩ |
| $R_{11}$ | = | 110 kΩ |
| $R_{14}$ | = | 5 kΩ |

It will be noted that, in the case where the junction point between diode $D_2$ and capacitor $C_5$ is connected directly to resistor $R_1$, resistors $R_{10}$ and $R_{11}$, transistor $T_3$ and auxiliary source $+V_a$ are omitted and capacitors $C_4$ and $C_5$ have respectively values of 3.3 μF and 4.7 μF.

With the diagram of FIG. 4, the following results are obtained in the different modes of operation.

(1) Detection of the Acupuncture Point

In this mode, the user acts on the touch control 13 so as to close switch CA and to switch on the apparatus. Since no action is exerted on touch controls 14 and 15, all the other switches remain open. Under these conditions, the voltage applied to resistor $R_1$ is equal to about 5 V, the peak-to-peak voltage ΔV of the sawtooth signal is about equal to 2 V, $t_2$ is about equal to 4 μs and, for an average value of 500 kΩ for variable resistor P, a means current is obtained of 0.8 μA and the mean frequency F of the sawtooth signal is approximately equal to 200 Hz when the contact needle PT is placed on acupuncture point and less than 130 Hz when said contact needle is not on an acupuncture point. The energy transferred on discharge of capacitor $C_0$ is proportional to the product $t_2 \cdot \Delta V = 8$ V. μs.

For a zero or substantially zero value of variable resistor P, a mean current of 1.8 μA is obtained, and a frequency F approximately equal to 400 Hz when contact needle PT is on an acupuncture point, and to 200 Hz when the contact needle is not on an acupuncture point.

(2) Soft Treatment

In this case, the user acts on touch control 13 and on one of the two metal areas 21 of touch control 14. Under these conditions, switch $CA_{1d}$ closes, thus causing switches $CA_{1a}$, $CA_{1b}$, $CA_{1c}$ and $CA_{12}$ to close and clock 3 to start up. Capacitor $C_1$ is then placed in parallel across capacitor $C_0$ and the resulting capacity is equal to $C_1+C_0=55$ nF. Similarly, resistor $R_5$ is placed in parallel across resistor $R_3$ and the equivalent resistance is equal to about 42 kΩ. Furthermore, resistor $R_8$ is short-circuited and we have $R_7+R_9=89$ kΩ, so that clock 3 delivers rectangular pulses at a frequency of about 500 Hz. The DC voltage which is obtained after voltage doubling and integration and which is applied to resistor $R_1$ is equal to about 10 V. Therefore, the peak-to-peak voltage ΔV of the sawtooth signal is equal to about 4 V, and $t_2$ is equal to about 10 μs. The energy transferred on discharge of capacitors $C_0$ and $C_1$ is then proportional to 40 V.μs. Moreover, for a mean value of 500 kΩ of variable resistor P, a mean current of 6.6 μA is obtained and a mean frequency F of the sawtooth signal of about 35 Hz, these two latter values may be adjusted by means of variable resistor P.

For a zero or substantially zero value of variable resistor P, a mean current of 40 μA and a frequency F of about 200 Hz are obtained.

This mode of operation may also be used for searching for acupuncture points which are particularly difficult to localize.

(3) Normal Treatment

In this case, the user acts both on touch control 13 and on one of the two metal areas 24 of touch control 15 thus causing, in addition to closure of switch CA, closure of switch $C_{2d}$ and, therefore, of switches $CA_{2a}$, $CA_{2b}$, $CA_{2c}$ and $CA_{12}$, and starting up of clock 3. The operation is similar to that obtained in the case of soft treatment, but in this case capacitor $C_2$ is placed in parallel across capacitor $C_0$ and the resulting capacity is equal to $C_0+C_2=0.1$ μF. Resistor $R_6$ is placed in parallel across the assembly of resistor $R_3$ and variable resistor P and the equivalent resistance is then equal to about 14 kΩ. Resistor $R_9$ is shortcircuited and we have $R_7+R_8=63$ kΩ. Clock 3 delivers rectangular pulses having a frequency equal to about 1000 Hz. In this case, the DC voltage applied to resistor $R_1$ is equal to about 13.5 V. Therefore, the peak-to-peak voltage ΔV of the sawtooth signal is equal to about 5.5 V and $t_2$ is equal to about 20 μs. The energy transferred on discharge of capacitors $C_0$ and $C_2$ is therefore proportional to 110 V.μs. The sawtooth signal has a mean current of about 100 μA and a mean frequency F of about 200 Hz, these two values being practically independent of the setting of variable resistor P.

(4) Strong Treatment

In this case, the user acts simultaneously on touch control 13, on one of the two metal areas 21 of touch control 14 and on one of the two metal areas 24 of touch control 15, thus causing all the switches to close. The result is that capacitors $C_1$ and $C_2$ are placed in parallel across capacitor $C_0$ and the resulting capacity is equal to 0.13 μF. Similarly, resistor $R_5$ is placed in parallel across resistor $R_3$ and resistor $R_6$ is placed in parallel across the assembly of resistor $R_3$ and variable resistor P, and the equivalent resistance is equal to about 10 KΩ. Finally, resistors $R_8$ and $R_9$ are short-circuited and clock 3 delivers rectangular pulses having a frequency equal to about 1500 Hz. The DC voltage applied to resistor $R_1$ is equal to about 16 V. Therefore, the peak-to-peak voltage ΔV of the sawtooth signal is equal to about 7.5 V and $t_2$ is equal to about 27 μs. The energy transferred on discharge of capacitors $C_0$, $C_1$ and $C_2$ is therefore proportional to 200 V·μs. The sawtooth signal has a mean current of about 150 μA and a mean frequency F equal to about 166 Hz.

From the example given above it is clear that the apparatus of the present invention provides, in the acupuncture point detection mode, a high resistance value in series with the contact needle TP and low values of capacity $C_0$ and of peak-to-peak voltage ΔV, thus allowing a reduction in current and in the energy transferred on discharge of capacitor $C_0$, while maintaining good frequency selectivity for the detection of the acupuncture point. Furthermore, in the treatment or stimulation mode, the apparatus of the invention allows on the one hand the ohmic value of the overall resistance in series with contact needle PT to be reduced and, on the other hand, the value of the capacity and the value of the peak-to-peak voltage ΔV to be increased, which allows a considerable increase in current and in transferred energy to be obtained with respect to those which are required for detection, while maintaining a process of repolarization of the cutaneous tissue which is close to the natural process. Furthermore, the apparatus of the invention which has been described above allows three degrees of treatment or stimulation to be easily obtained. It is obvious that, if desired, an even greater number of degrees of treatment may be provided by providing other capacitors, other resistors and other switches arranged in a way similar to that which has been described. It will be noted moreover that the use of the apparatus is greatly facilitated because all the controls, except variable resistor P, are grouped together on the body of proble S.

Because of the extremely low power required for operation of this apparatus, integrated circuits of the C-MOS type may be used for its construction which can easily withstand a variable power supply, 3 to 18 V for example. By way of indication, logic NAND gates 6, 7 and 10 may be formed by integrated circuits model 4011 and the analog switches may be formed by integrated circuits model 4016 or 4086.

It will be further noted that a source of variable-frequency rectangular pulses (clock 3) is available in the apparatus of the invention. If desired, these rectangular pulses may be easily used as stimulating signal instead of the saw-tooth signal generated by relaxation oscillator OSC. To this end, it is sufficient to connect the output of clock 3 to resistor $R_3$ through a first normally open switching device and to open the connection between resistor $R_3$ and capacitors $C_0$, $C_1$ and $C_2$ by means of a second normally closed switching device, these two switching devices being controlled by a single control means adapted to close said first switching device and to open said second switching device.

It will be readily understood that the embodiment of the apparatus of the invention which has been described above has been given by way of example, and that many modifications may be easily through up by anyone skilled in the art without departing from the scope and spirit of the present invention.

What is claimed is:

1. Apparatus for detecting the acupuncture points of a patient and for applying electrical stimulating signals to the detected points, comprising a main DC voltage source, a probe having a contact needle, an electrode to be held by a patient, a sawtooth signal generator connected to said main DC voltage source for producing a sawtooth signal and having an RC circuit determining the rise time of each sawtooth of said sawtooth signal, said RC circuit including a first capacitor and a resistive circuit which comprises, connected in series, a first fixed resistor and a variable resistor, said first capacitor having one terminal connected to one pole of said main DC voltage source and another terminal connected to one end of said resistive circuit, one of said contact needle and electrode being connected to another end of said resistive circuit and the other of said contact needle and electrode being connected to another pole of said main DC voltage source, a second fixed resistor, a second capacitor, DC voltage booster means connected to said sawtooth signal generator for supplying, when activated, said sawtooth signal generator with a DC voltage higher than that of said main DC voltage source, and mode-changing means for selecting between an acupuncture point detection mode and a soft stimulation mode, said mode-changing means comprising first, second and third switch means which are associated with said second resistor, said second capacitor and said DC voltage booster means, respectively, and which, when switched in a state corresponding to said soft stimulation mode, combines said second fixed resistor with said resistive circuit so that the resultant resistance of the combined second resistor and resistive circuit is lower than the resistance of said resistive circuit, combines said second capacitor with said first capacitor so that the resultant capacitance of the combined first and second capacitors is higher than the capacitance of said first capacitor, and activates said DC voltage booster means, respectively.

2. The apparatus as claimed in claim 1, wherein said first and second switch means, when closed in the soft stimulation mode, connect said second resistor in parallel across said first resistor and said second capacitor in parallel across said first capacitor, respectively.

3. The apparatus as claimed in claim 2, further comprising a third fixed resistor and a third capacitor, and wherein said mode-changing means further comprise fourth and fifth switch means for selecting, when they are actuated and when said first, second and third switch means are not actuated, a normal stimulation mode and, when they are actuated simultaneously with said first, second and third switch means, a strong stimulation mode, said fourth and fifth switch means, when actuated, connecting said third fixed resistor in parallel across the assembly of said first fixed resistor and variable resistor, and said third capacitor in parallel across said first capacitor, respectively.

4. The apparatus as claimed in claim 3, wherein said DC voltage booster means comprises means for generating a variable-frequency signal including an RC circuit having an RC value which can be changed for changing the frequency of said variable-frequency signal, a voltage multiplier connected to the output of said variable-frequency signal generating means and an integrator connected to the output of said voltage multiplier, and said mode-changing means comprise sixth switch means, said third and sixth switch means being associated with the RC circuit of said variable-frequency signal generating means for changing the RC value thereof, the RC circuit of said variable-frequency signal generating means having a first RC value determining a first frequency of said variable-frequency signal when said third switch means are actuated in the soft stimulation mode, thereby causing said DC voltage booster means to produce a first DC voltage higher than that of said main DC voltage source, a second RC value determining a second frequency higher than said first frequency when said sixth switch means are actuated in the normal stimulation mode, thereby causing said DC voltage booster means to produce a second DC voltage higher than said first DC voltage, and a third RC value determining a third frequency higher than said second frequency when both said third and sixth switch means are actuated in the strong stimulation mode, thereby causing said DC voltage booster means to produce a third DC voltage higher than said second DC voltage.

5. The apparatus as claimed in claim 4, wherein the RC circuit of said variable-frequency signal generating means comprises a fourth capacitor and fourth, fifth and sixth series-connected resistors, and said third and sixth switch means, when closed, short-circuit said fifth and sixth resistors, respectively.

6. The apparatus as claimed in claim 4, comprising a first control means associated with said first, second and third switch means for actuating simultaneously said first, second and third switch means, and a second control means associated with said fourth, fifth and sixth switch means for actuating simultaneously said fourth, fifth and sixth switch means.

7. The apparatus as claimed in claim 6, comprising a housing containing said sawtooth signal generator, said DC voltage booster means and said first, second, third, fourth, fifth and sixth switch means of said mode-changing means, and a flexible multiwire cable connecting the needle of said probe to said sawtooth signal generator, said first and second control means being disposed on said probe and being connected to said first, second and third switch means and to said fourth, fifth and sixth switch means, respectively, through said flexible multiwire cable.

8. The apparatus as claimed in claim 7, wherein each of said first and second control means comprise at least one touch control disposed on said probe and an electronic switch disposed in said housing and having a control terminal connected to said touch control through said flexible multiwire cable, each of said first, second and third switch means being an electronic switch having a control terminal connected to the electronic switch of said first control means, and each of said fourth, fifth and sixth switch means being an electronic switch having a control terminal connected to the electronic switch of said second control means.

9. The apparatus as claimed in claim 7, comprising an ON/OFF switch means for controlling the main DC voltage source, said ON/OFF switch means comprising a touch control disposed on said probe and an electronic switch disposed in said housing and having a control terminal connected to the touch control of said ON/-OFF switch means through said flexible multiwire cable.

* * * * *